US006635189B2

(12) United States Patent
Suh et al.

(10) Patent No.: US 6,635,189 B2
(45) Date of Patent: Oct. 21, 2003

(54) ELECTRO-RHEOLOGICAL FLUID COMPRISING DRIED WATER-SOLUBLE STARCH AS A CONDUCTIVE PARTICLE

(75) Inventors: Moon-Suk Suh, Daejon (KR); Min-Jae Shin, Daejon (KR); Kyo-Jun Choi, Daejon (KR); In-sik Han, Daejon (KR); Sun-Kyu Jeong, Yongin (KR); Seung-Bok Choi, Inchon (KR); Kum-Gil Sung, Seoul (KR); Ho-Guen Lee, Inchon (KR)

(73) Assignee: Agency for Defense Development, Daejon (KR)

( * ) Notice: Subject to any disclaimer, the term of this patent is extended or adjusted under 35 U.S.C. 154(b) by 89 days.

(21) Appl. No.: 09/784,976

(22) Filed: Feb. 16, 2001

(65) Prior Publication Data

US 2001/0015421 A1 Aug. 23, 2001

(30) Foreign Application Priority Data

Feb. 17, 2000 (KR) ..... 2000-7588

(51) Int. Cl.[7] ..... C09K 5/00

(52) U.S. Cl. ..... 252/73; 252/74; 252/75; 252/77; 252/79; 252/78.1; 252/572

(58) Field of Search ..... 252/73, 74, 75, 252/77, 79, 78.1, 572

(56) References Cited

U.S. PATENT DOCUMENTS 3,047,507 A * 6/1962 Winslow et al. ..... 252/75
3,970,573 A * 7/1976 Westhaver ..... 252/75
5,073,282 A * 12/1991 Ahmed et al. ..... 252/77
5,087,382 A * 2/1992 Ishino et al. ..... 252/73

OTHER PUBLICATIONS

H. Block and J.P. Kelly, "Electro–Rheology", i. Phys. D: Appl. Phys. 21 (1998) pp. 1661–1677.
W.M. Winslow, "Induced Fibration of Suspensions", Journal of Applied Physics, vol. 20, Dec. 1949, pp. 1137–1140.

* cited by examiner

*Primary Examiner*—Mark Kopec
*Assistant Examiner*—Derrick G. Hamlin
(74) *Attorney, Agent, or Firm*—Scully, Scott, Murphy & Presser

(57) ABSTRACT

The ER fluid comprising water-soluble starch as conductive particles contains less than 5 wt % water. The ER fluid of the present invention comprises water-soluble starch as a conductive particle which is dispersed in non-conductive media. The ER fluid of the present invention exhibits a considerable ER effect, even though the amount of water contained in the ER fluid is reduced. Thus, it can be widely applicable to water-sensitive damping devices and power devices such as a suspension system, a vibration damper or an engine mount, a break, a clutch, and so forth. And it is feasible for various fields such as an automatic and an aerospace industry.

13 Claims, 11 Drawing Sheets

ELECTRO-RHEOLOGICAL FLUID COMPRISING DRIED WATER-SOLUBLE STARCH AS A CONDUCTIVE PARTICLE

BACKGROUND OF THE INVENTION

1. Field of the Invention

The present invention relates to an electro-rheological fluid, more particularly to an electro-rheological fluid comprising non-conductive media, watersoluble starch as a conductive particle and less than 5 wt % water.

2. Description of the Background Art

Generally, Electro-rheological (ER) fluid refers to a fluid whose mechanical property is variable by applying an electric field. Basically, it is a colloidal fluid comprising highly conductive particles and viscous non-conductive media, wherein the conductive particles are dispersed in the non-conductive media. When an external electric field is applied to an ER fluid, the yield stress and dynamic viscosity of the ER fluid increase abruptly and reversibly. The ER fluid quickly reacts on the electric field, but is also capable of having a reversible reaction against the appliance of the electric field, which is known as an ER effect.

In FIGS. 1A and 1B, the microscopic mechanism of the ER fluid is presented.

As shown in FIG. 1A, when no electric field is applied, the ER fluid 101 exhibits a Newtonian fluid property, i.e. conductive particles 103 flow together with a media 102 within an electrode 104. As shown in FIG. 1B, when the electric field is applied, the ER fluid 101 displays a Bingham behavior wherein the yield stress increases as an external electric field is applied.

The initial ER fluid, developed at the end of the $19^{th}$ century, was composed of only a liquid, but it failed to give a satisfactory result (Duff, A. W., Physical Review, Vol. 4, No. 1, 23 (1986)).

Later, a solid dispersion system was first proposed by Winslow, which had given a considerable progress in the field of ER fluid [Winslow, W. H., J. of Applied Physics, Vol. 20, 1137(1949)]. Since then, researches have been conducted for a system comprising conductive particles and non-conductive media.

As the conductive particles, silica gel, water-soluble starch or a semiconductor material has been used.

It is well known that ER fluid comprising a water-soluble starch, which is known as an aqueous material, as conductive particles displays the ER effect only if it contains at least 5 wt % of water. That is, if the water content of the ER fluid comprising the water-soluble starch is less than 5 wt %, it cannot be used as an ER fluid because its reversibility rapidly degrades. However, the water contained in ER fluid can cause the corrosion of device, restrict its operation temperature, and incur high power consumption. Therefore, there has been an intense study on the development of ER fluid having the reduced water content has been intensively tried.

SUMMARY OF THE INVENTION

Therefore, an object of the present invention is to provide an ER fluid comprising a dried water-soluble starch as conductive particles and which has an excellent ER effect even though the ER fluid contains less than 5 wt % of water.

To achieve these and other advantages, the present invention also provides a method for producing an ER fluid, comprising the steps of: grinding water-soluble starch particles in a grinder so as to render the particle size less than 10 $\mu$m; drying the thusly obtained water-soluble starch particles in a thermohygrostat chamber in a temperature of 35~45° C. and relative humidity of 30~50%; mixing the dried water-soluble starch particles and a non-conductive media in a container at a proper weight ratio; boiling the obtained fluid in an oil bath of 100~150° C.; grinding the obtained ER fluid in a grinder so as to homogenize and evenly mix the particles.

BRIEF DESCRIPTION OF THE DRAWINGS

The accompanying drawings, which are included to provide a further understanding of the invention and are incorporated in and constitute a part of this specification, serve to explain the principles of the present invention.

In the drawings.

DETAILED DESCRIPTION OF THE PREFERRED EMBODIMENTS

Reference will now be made in detail to the preferred embodiments of the present invention, examples of which are illustrated in the accompanying drawings.

The ER fluid of the present invention comprises non-conductive media, water-soluble starch and less than 5 wt % water, preferably less than 3 wt % water, and more preferably less than 1 wt % water.

The amount of the water-soluble starch used in the ER fluid as a conductive particles is 5–70 wt %, preferably 20–60 wt %, and the most preferably 30–60 wt % of the non-conductive media. According to the embodiments of the present invention, as the amount of the water-soluble starch used increases, the property of the ER fluid improves. The particle diameter of the water-soluble starch is preferably less than 10 $\mu$m.

Any material that it does not have an adverse influence on the other components (water-soluble starch and other components) can be used as the non-conductive media without limitation. It is also preferred that it has an adequate stability within a normal operation temperature range and has a low viscosity when the electric field is neutral so that it contains a large amount of conductive particles. For example, silicon oil, transformer oil, transformer insulating fluid, mineral oil or olive oil or a mixture thereof may be used, but are not limited thereto.

The ER fluid of the present invention may comprise other components in so far as they do not have an adverse influence on the property of the nonconductive media and the water-soluble starch, such as an aromatic hydroxyl compound disclosed in U.S. Pat. No. 5,683,629, or other conductive particles including silica gel.

Figure 4A:
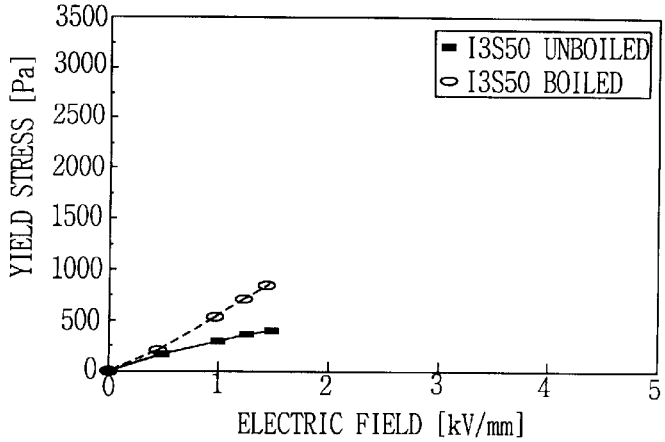
FIGS. 4A and 4B are graphs showing experimental results of the ER fluid using water-soluble starch (weight ratio 50%, comparing the results when the fluid was boiled and not boiled.
Figure 4B:
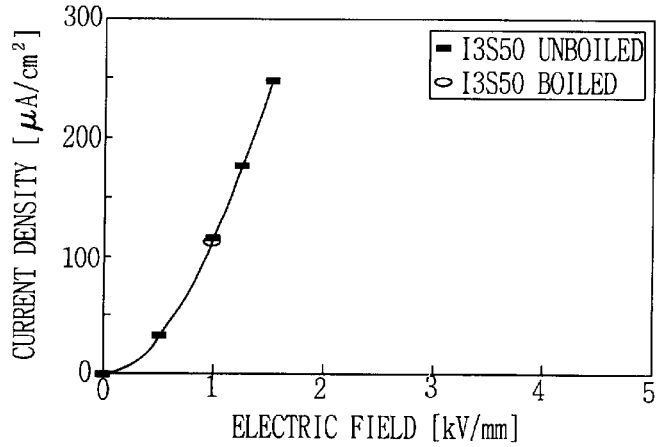

The property of the ER fluid of the present invention is enhanced by a heat treatment. FIGS. 4A and 4B are graphs comparatively showing the yield stress and current density of the ER fluids that were boiled and of ER fluid that were not boiled.

With reference to FIG. 4B, it was noted that the current density according to the intensity of the electric field, the boiled ER fluid and the non-boiled ER fluid have almost the same values, while, referring to FIG. 4A, the yield stress of the boiled ER fluid is double that of the non-boiled ER fluid. Accordingly, it was noted that performance of the ER fluid comprising the water-soluble starch can be improved by boiling.

Figure 1A:
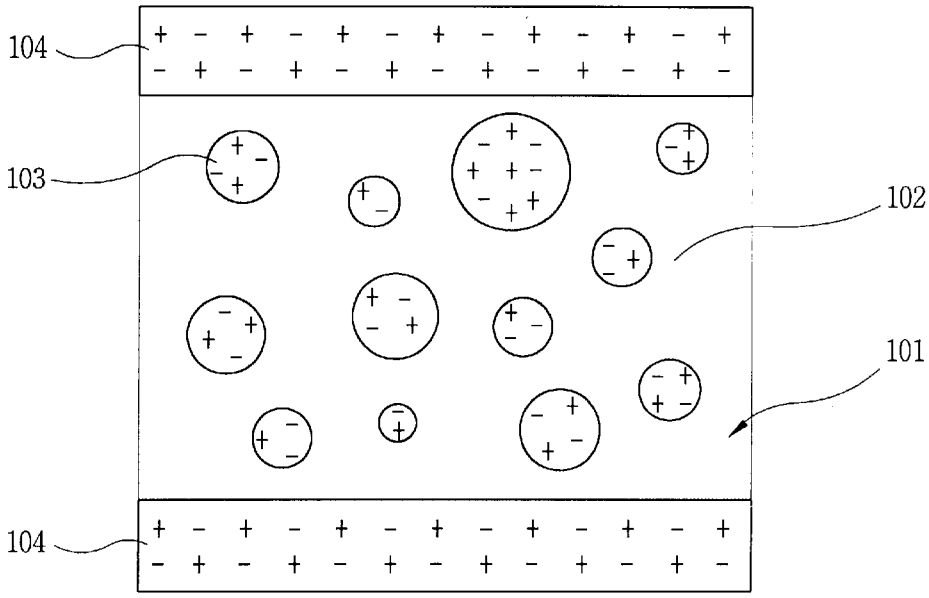
FIG. 1A CONVENTIONAL ART
FIGS. 1A and 1B are microscopic schematic views of an ER effect according to the appliance of an electric field.
Figure 1B:
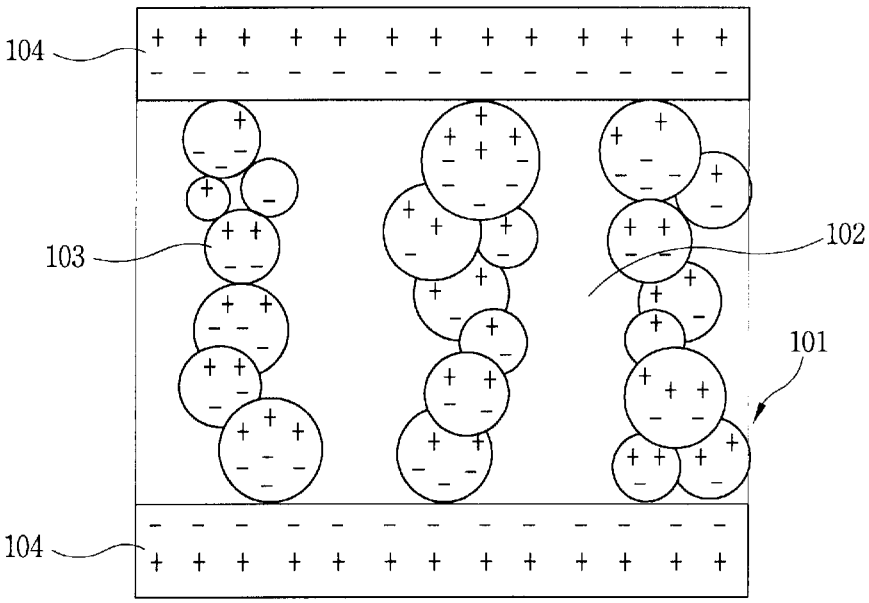
FIG. 1B CONVENTIONAL ART
Figure 2:
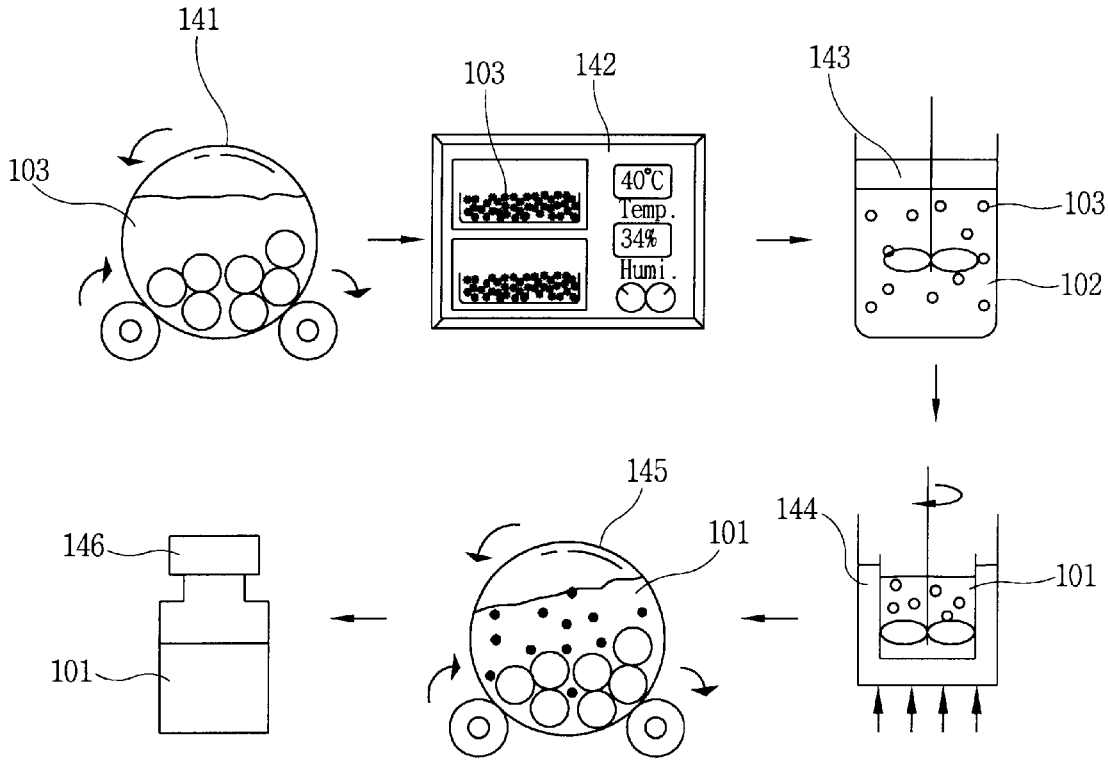
FIG. 2 graphically illustrates the sequence method of producing an ER fluid in accordance with the present invention.

The method for producing the ER fluid includes the steps of grinding and drying the water-soluble starch, mixing the water-soluble starch with non-conductive particles and bath heating. FIG. 2 graphically illustrates the method for producing the ER fluid of the present invention, which includes the steps of:

1) grinding water-soluble starch particles 103 in a grinder 141 so as to produce water-soluble starch particle sizes of less than 10 $\mu$m,
2) drying the thusly obtained water-soluble starch particles in a thermohygrostat chamber 142 at a temperature of 35~45° C. and relative humidity of 0~50%,
3) mixing the dried water-soluble starch particles 103 and the non-conductive solvent 102 at a proper weight ratio in a receptacle 143,
4) heating the obtained fluid in an oil bath 144 of 100~150° C.,
5) grinding the composed ER fluid 101 evenly in a grinder 145, and
6) storing the completed ER fluid in a bottle 146.

The water content of the ER fluid produced by the above method is kept at less than 5 wt %, preferably at 3 wt %, and most preferably at 1 wt %. In this respect, in step 2) the range of the temperature of the thermohygrostat chamber and the range of the relative humidity can be suitably adjusted within the limitation of not going beyond the above-mentioned water content range of the ER fluid.

Figure 3A:
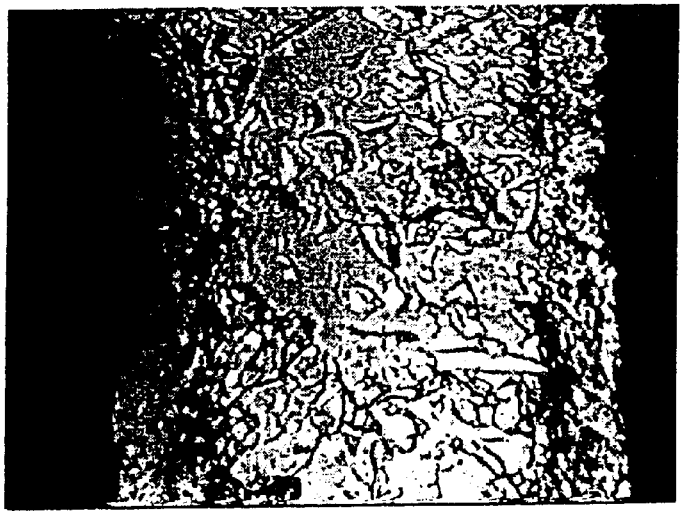
FIGS. 3A and 3B are microscopic photographs showing the ER effect of the ER fluid when the electric field is applied thereto in accordance with the present invention.
Figure 3B:
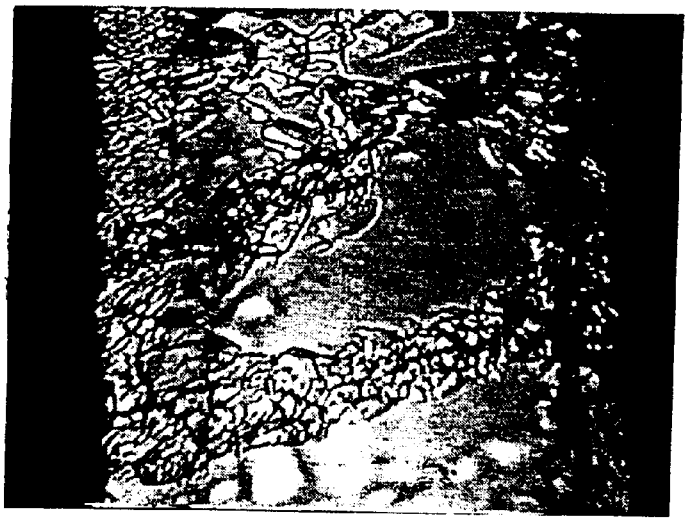

FIGS. 3A and 3B are microscopic photographs showing that the ER fluid of the present invention having an ER effect when the electric field is applied.

As shown in FIG. 3A, the water-soluble starch particles dispersed in the non-conductive media show the properties of a Newtonian fluid when no electric field is applied. Meanwhile, when electric field is applied (referring to FIG. 3B), the water-soluble starch particles form a chain structure in the electric field direction vertical to two electrodes that are in parallel, which increases the yield stress and exhibits a Bingham behavior. The microscopic photographs are taken by applying electric field of 3 kV/nm at the two parallel electrodes spaced apart by 1 mm.

In order to take the effect of the water contained in ER fluid into consideration, the variation of the property of ER fluid according to the change of the temperature was observed. FIGS. 5 through 15 show the results of the experiment with respect to an effect of the weight ratio of the water-soluble starch particles over the non-conductive solvent and with respect to the behavior variation according to the viscosity variation of the solvent.

Figure 5A:
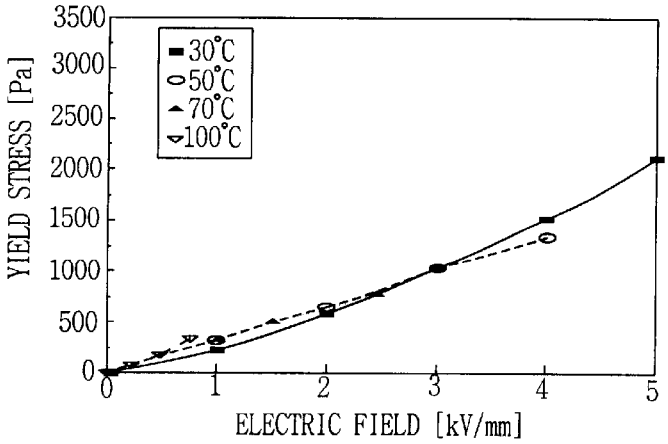
FIGS. 5A and 5B are graphs showing experimental results of the ER fluid using water-soluble starch (weight ratio 40%, dried for three days, and not boiled)
Figure 5B:
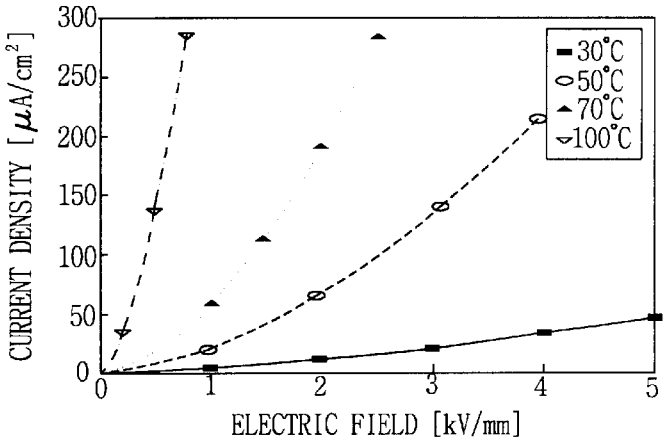
Figure 6A:
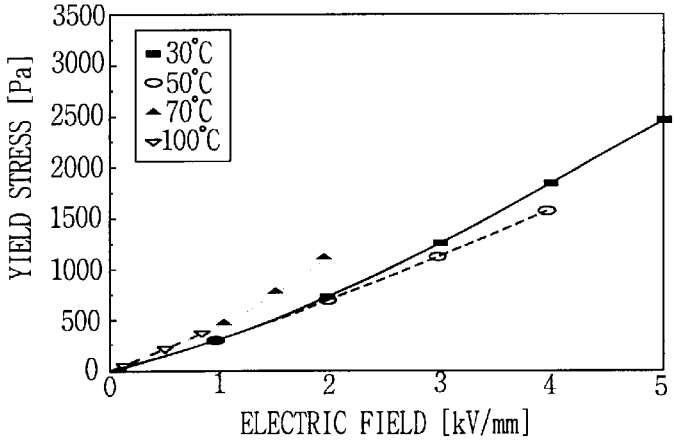
FIGS. 6A and 6B are graphs showing experimental results of the ER fluid using water-soluble starch (weight ratio 45%, dried for three days, and not boiled)
Figure 6B:
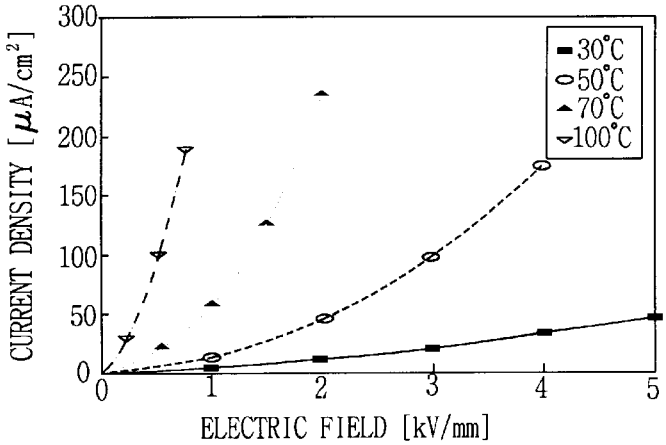
Figure 7A:
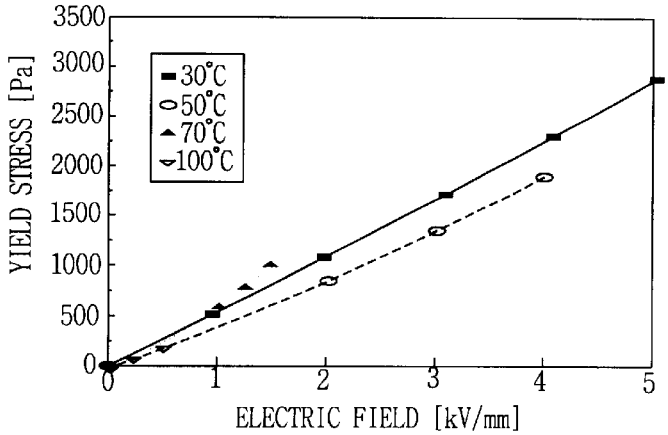
FIGS. 7A and 7B are graphs showing experimental results of the ER fluid using water-soluble starch (weight ratio 50%, dried for three days, and not boiled)
Figure 7B:
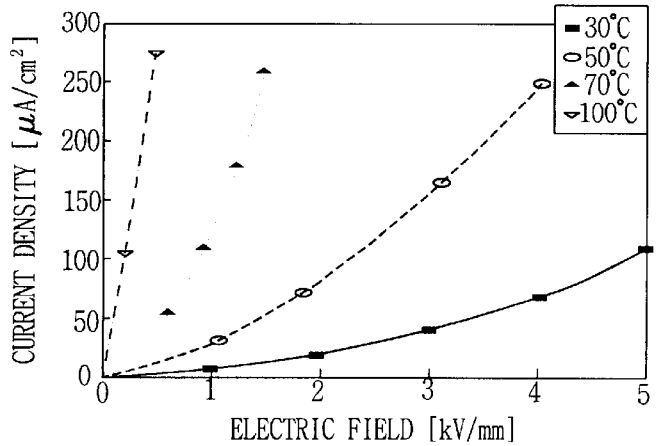

FIGS. 5 through 7 show the results of the experiment of the Bingham property of the ER fluid using the water-soluble starch (experiment condition: weight ratios of the water-soluble starch over the non-conductive solvent are 40%, 45% and 50%, respectively, and the ER fluid was dried for three days in the thermohygrostat chamber and unheated). It is noted that the ER effect was heightened as the weight ratio of the water-soluble starch particles was increased.

Figure 8A:
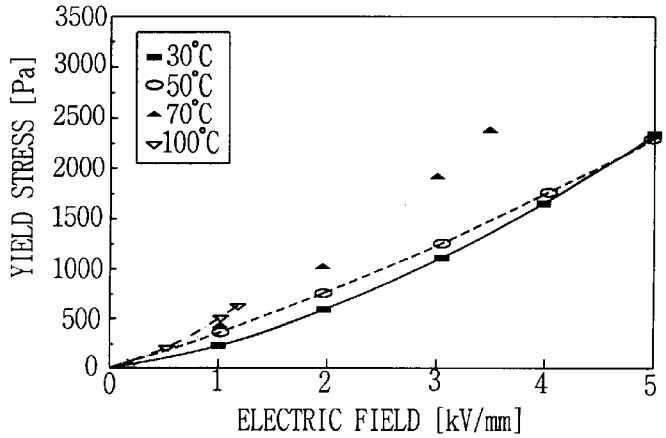
FIGS. 8A and 8B are graphs showing experimental results of the ER fluid using water-soluble starch (weight ratio 40%, dried for three days, and boiled for fifteen minutes)
Figure 8B:
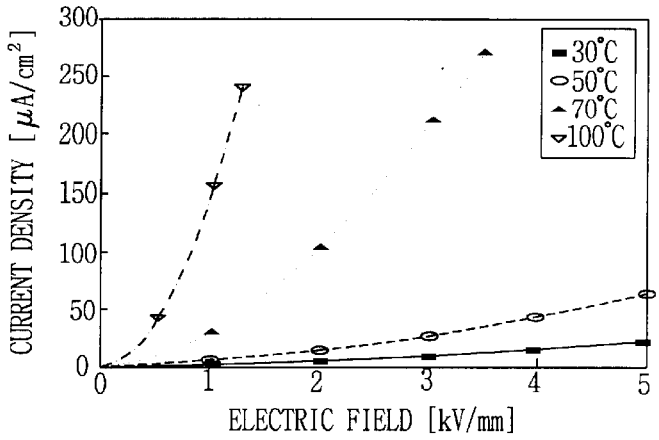
Figure 9A:
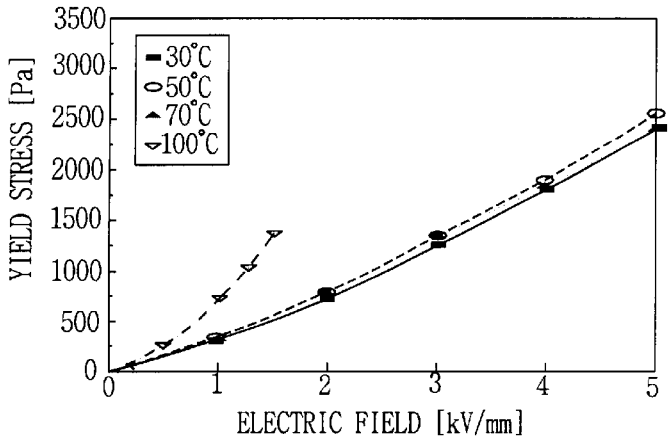
FIGS. 9A and 9B are graphs showing experimental results of the ER fluid using water-soluble starch (weight ratio 45%, dried for three days, and boiled for fifteen minutes)
Figure 9B:
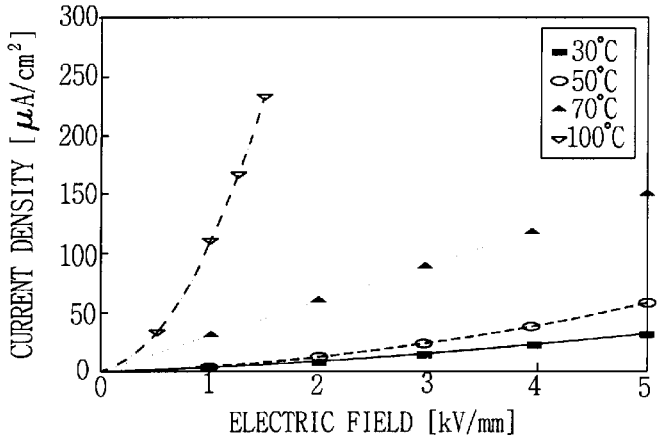
Figure 10A:
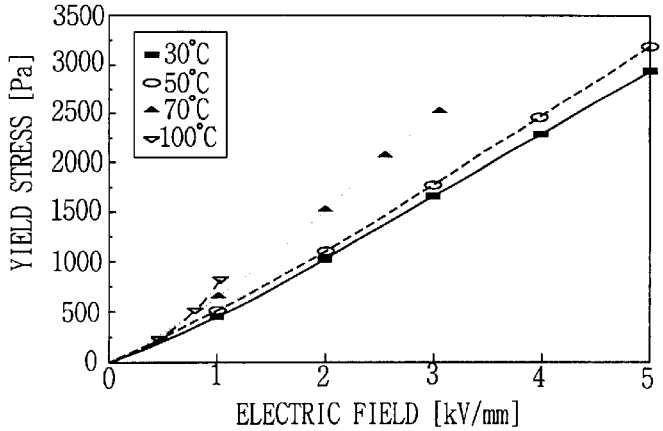
FIGS. 10A and 10B are graphs showing experimental results of the ER fluid using water-soluble starch (weight ratio 50%, dried for three days, and boiled for fifteen minutes)
Figure 10B:
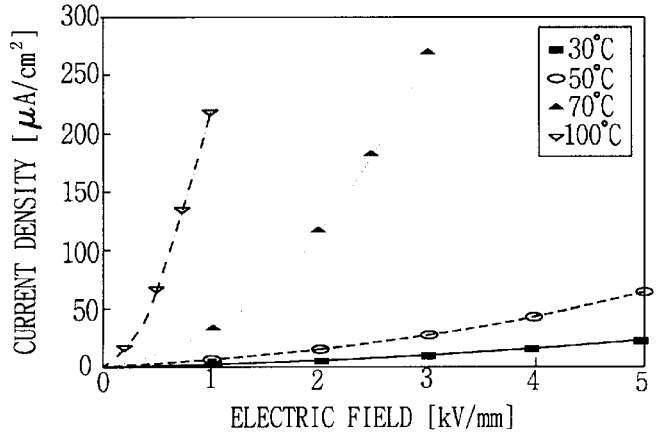

FIGS. 8 through 10 show experimental results of the Bingham property of the ER fluid using the water-soluble starch, of which experiment condition was that weight ratios are 40%, 45% and 50%, respectively, and the ER fluid were dried for three days and heated. It is noted that the ER effect was heightened as the weight ratio of the water-soluble starch particles were increased, and the ER effect was better compared to the case of non-boiling. Especially, the ER effect was heightened at a high temperature.

Figure 11A:
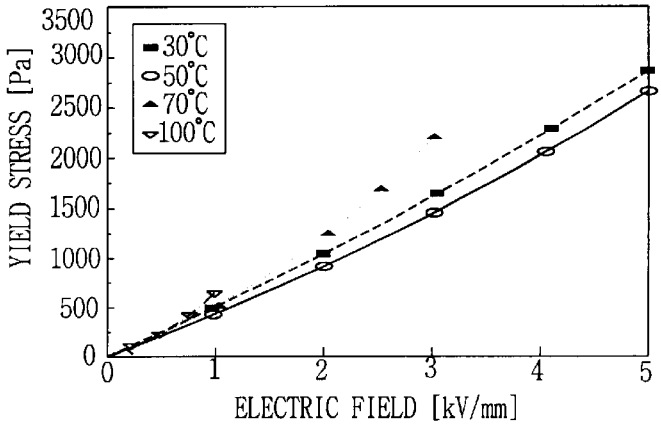
FIGS. 11A and 11B are graphs showing experimental results of the ER fluid using water-soluble starch (weight ratio 50%, dried for five days, and boiled for fifteen minutes)
Figure 11B:
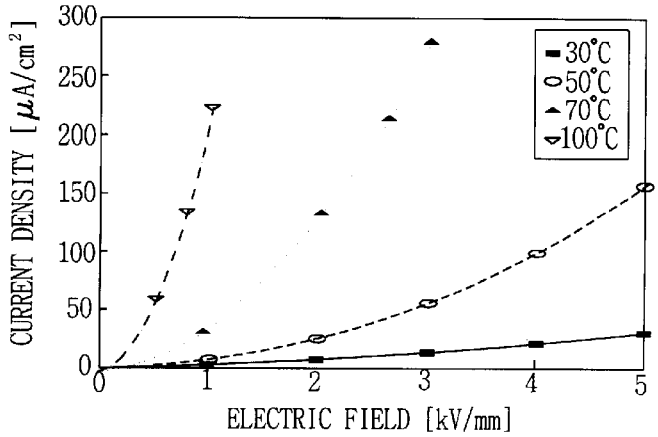
Figure 12A:
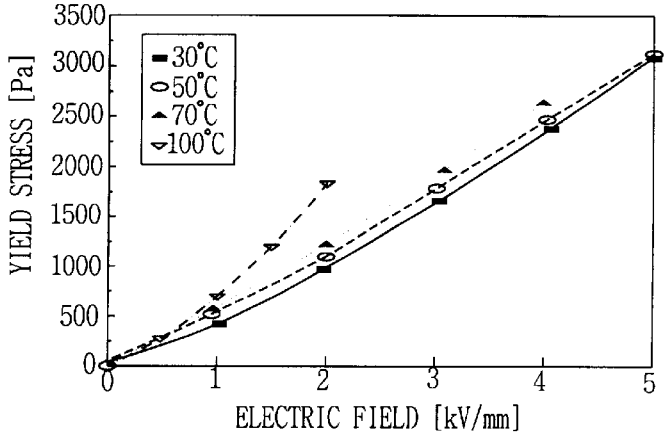
FIGS. 12A and 12B are graphs showing experimental results of the ER fluid using water-soluble starch (weight ratio 50%, dried for seven days, and boiled for fifteen minutes)
Figure 12B:
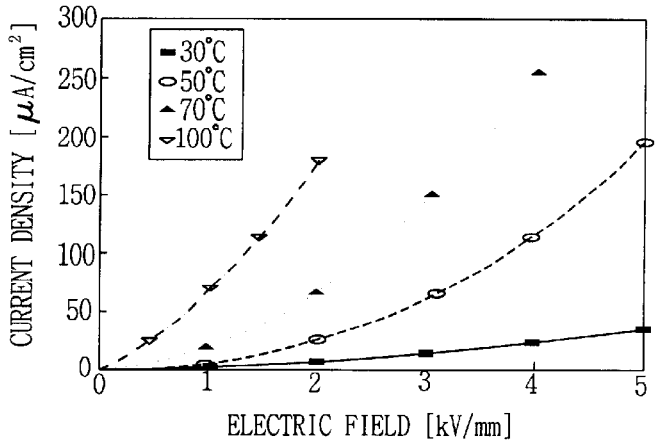
Figure 13A:
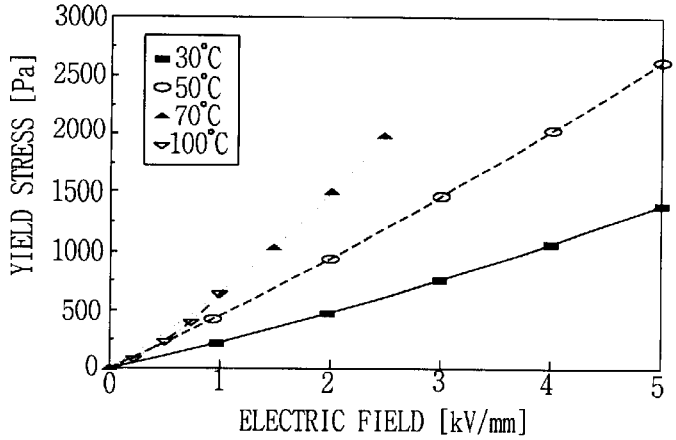
FIGS. 13A and 13B are graphs showing experimental results of the ER fluid using water-soluble starch (weight ratio 50%, dried for eleven days, and boiled for fifteen minutes)
Figure 13B:
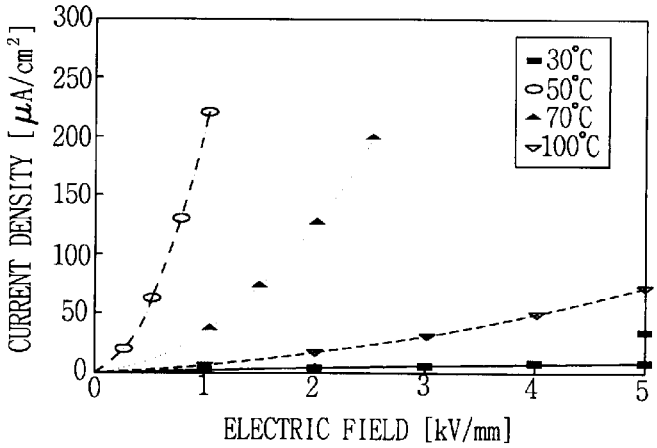

FIGS. 11 through 13 show experiment results of the Bingham property of the ER fluid using the water-soluble starch, of which experiment condition was that weight ratio was 50%, and the ER fluid was dried for five days, seven days and eleven days, respectivley, and boiled for fifteen minutes. It was observed that the best result was obtained by seven-day drying.

Figure 14A:
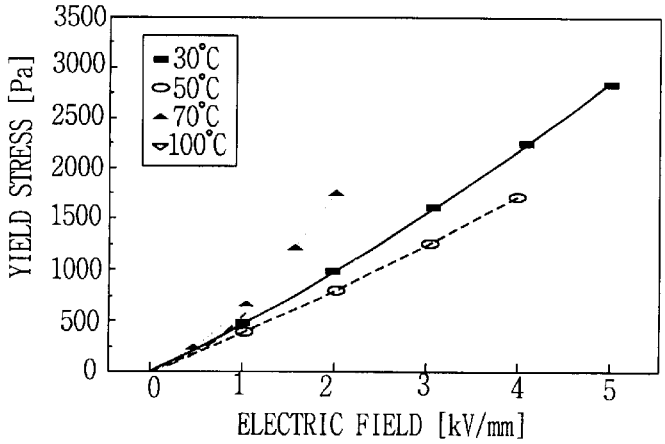
FIGS. 14A and 14B are graphs showing experimental results of the ER fluid using water-soluble starch (weight ratio 50%, dried for seven days, and boiled for five minutes)
Figure 14B:
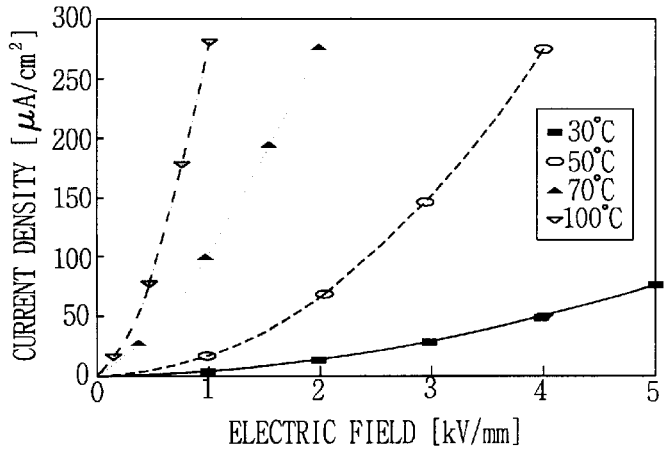
Figure 15A:
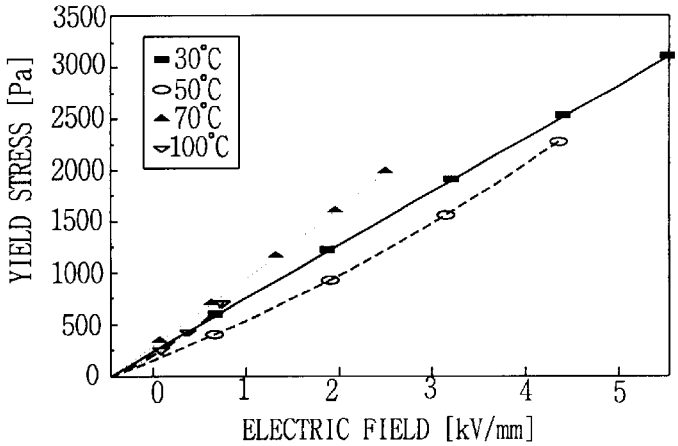
FIGS. 15A and 15B are graphs showing experimental results of the ER fluid using water-soluble starch (weight ratio 50%, dried for seven days, and boiled for thirty minutes).
Figure 15B:
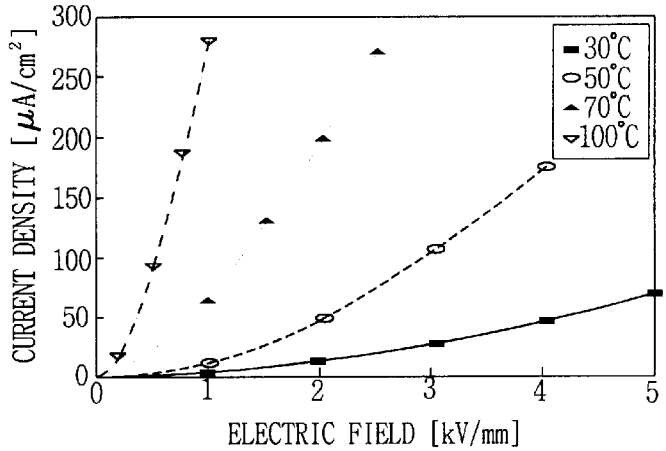

FIGS. 14 and 15 show experiment results of the Bingham property of the ER fluid using the water-soluble starch. The weight ratio was set to 50% for two cases, particles were dried for seven days and boiled for five minutes and thirty minutes, respectively. Boiling for fifteen minutes is as shown in FIG. 12. It is noted that the ER effect was heightened as the boiling time was lengthened until fifteen minutes, and if the ER fluid is boiled longer than that, the ER effect was slightly reduced.

The water-soluble starch used in the experiment is selectively dissolved and dispersed to a non-conductive solvent such as silicon oil. And, when electrical polarization is generated, the conductive particles thereof are polarized, which causes the ER effect. The polarization includes an electronic polarization, an ion polarization and a molecular polarization and these phenomena occur together rather than being separately acted. Likewise, in case of the water-soluble starch, those polarization phenomena occurs together to cause the ER effect.

As so far described, the ER fluid of conventional art using the water-soluble starch is disadvantageous in that it does not have an ER effect at a high temperature and its current density is too high to be applied to an actual application device. But the ER fluid of the present invention has the ER effect at any temperature range. In addition, the ER effect becomes greater as the electric field is increased, the particle weight ratio is increased, and the viscosity of the solvent is increased. Its response time, which is critical in case that it is controlled by being applied to an application device, is very short. Also, it requires a little current amount to have the ER effect, consuming less power. And, a stable Bingham behavior is maintained for the variation of the electric field.

The ER fluid of the present invention can be widely applicable to water-sensitive damping devices and power devices such as a suspension system, a vibration damper or an engine mount, a break, a clutch, and so forth. And it is feasible for various fields such as an automatic and an aerospace industry.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. An electro-rheological (ER) fluid comprising a water soluble starch as a conductive particle disposed in non-conductive media, wherein the water content of the ER fluid is less than 5 wt %, the content of the water soluble starch is 5–70 wt % of the non-conductive media and the ER fluid is boiled.

2. The ER fluid according to claim 1, wherein the water content is less than 3 wt %.

3. The ER fluid according to claim 1, wherein the water content is less than 1 wt %.

4. The ER fluid according to claim 1, wherein the non-conductive media is selected from the group consisting of silicon oil, transformer oil, transformer insulating solution, mineral oil, olive oil, and their mixture.

5. The ER fluid according to claim 2, wherein the non-conductive media is selected from the group consisting of silicon oil, transformer oil, transformer insulating solution, mineral oil, olive oil, and their mixture.

6. The ER fluid according to claim 3, wherein the non-conductive solvent is selected from the group consisting of silicon oil, transformer oil, transformer insulating solution, mineral oil, olive oil, and their mixture.

7. The ER fluid according to claim 1, wherein the content of the water-soluble starch is 5~70 wt % of the non-conductive solvent.

8. The ER fluid according to claim 3, wherein the content of the water-soluble starch is 5~70 wt % of the non-conductive solvent.

9. The ER fluid according to claim 1 which is obtained by grinding and drying of the water-soluble starch and then mixing it with the non-conductive particles.

10. The ER fluid according to claim 2 which is obtained by grinding and drying of the water-soluble starch and then mixing it with the non-conductive particles.

11. The ER fluid according to claim 3 which is obtained by grinding and drying of the water-soluble starch and then mixing it with the non-conductive particles.

12. A method for fabricating an ER fluid according to claim 1 comprising the steps of:

(a) grinding the water soluble starch particle in a grinder so as to have a size less than 10 $\mu$m;

(b) drying the thusly obtained water soluble starch particle in a thermohygrostat chamber of which the temperature is 35–45° C. and the relative, humidity is 30–50% for sufficient time to reduce the water content to less than 5 wt %;

(c) mixing the dried water soluble starch particle and the nonconductive solvent;

(d) boiling the obtained fluid in an oil bath of 100–150° C.; and (e) grinding the obtained ER fluid in a grinder so that the particles are homogenized and are evenly mixed.

13. The method according to claim 12, wherein the amount of the dried water-soluble starch particles in step c) is 5~70 wt % of the non-conductive solvent.

* * * * *